US007594990B2

(12) United States Patent
Satchell, Jr.

(10) Patent No.: US 7,594,990 B2
(45) Date of Patent: Sep. 29, 2009

(54) HYDROGEN DONOR SOLVENT PRODUCTION AND USE IN RESID HYDROCRACKING PROCESSES

(75) Inventor: Donald Prentice Satchell, Jr., Chatham, NJ (US)

(73) Assignee: The BOC Group, Inc., Murray Hill, NJ (US)

( * ) Notice: Subject to any disclaimer, the term of this patent is extended or adjusted under 35 U.S.C. 154(b) by 389 days.

(21) Appl. No.: 11/499,923

(22) Filed: Aug. 7, 2006

(65) Prior Publication Data

US 2007/0108100 A1 May 17, 2007

Related U.S. Application Data

(60) Provisional application No. 60/736,397, filed on Nov. 14, 2005.

(51) Int. Cl.
*C10G 45/00* (2006.01)

(52) U.S. Cl. ..... 208/56; 208/44; 208/49; 208/431; 208/108

(58) Field of Classification Search ..... 208/49, 208/214, 44, 56, 58, 107, 145
See application file for complete search history.

(56) References Cited

U.S. PATENT DOCUMENTS 2,843,530 A 7/1958 Langer, Jr. et al.
2,873,245 A 2/1959 Thompson et al.
2,953,513 A 9/1960 Langer, Jr.
3,238,118 A 3/1966 Arey, Jr. et al.
4,002,556 A 1/1977 Satchell, Jr.
4,090,947 A 5/1978 Satchell, Jr.
4,115,246 A 9/1978 Sweany
4,292,168 A 9/1981 Derbyshire et al.
4,363,716 A 12/1982 Greene et al.
4,411,768 A 10/1983 Unger et al.
4,427,535 A 1/1984 Nongbri et al.
4,451,354 A * 5/1984 Stuntz ..... 208/56
4,457,830 A 7/1984 Kydd
4,495,060 A 1/1985 Abrams (Continued)

FOREIGN PATENT DOCUMENTS

EP 0 078 689 5/1983

(Continued)

OTHER PUBLICATIONS

European Search Report including Communication dated Feb. 26, 2007 and Annex (7 pages total) EP 06123470.4.

*Primary Examiner*—Walter D Griffin
*Assistant Examiner*—Jerrod B Marten
(74) *Attorney, Agent, or Firm*—Philip H. Von Neida

(57) ABSTRACT

A process derived hydrogen donor solvent is used to increase the maximum resid conversion and conversion rate in an ebullated bed resid hydrocracker. The hydrogen donor solvent precursor is produced by hydroreforming reactions within the resid hydrocracker, recovered as the resin fraction from a solvent deasphalting unit, regenerated in a separate hydrotreater reactor, and recycled to the ebullated bed resid hydrocracker. The major advantage of this invention relative to earlier processes is that hydrogen is more efficiently transferred to the resin residual oil in the separate hydrotreater and the hydrogen donor solvent effectively retards the formation of coke precursors at higher ebullated bed resid hydrocracker operating temperatures and resid cracking rates.

15 Claims, 1 Drawing Sheet

U.S. PATENT DOCUMENTS

| | | | | |
|---|---|---|---|---|
| 4,521,295 | A | | 6/1985 | Chervenak et al. |
| 4,525,267 | A | * | 6/1985 | Inooka ..... 208/58 |
| 4,640,765 | A | | 2/1987 | Kubo |
| 4,686,028 | A | | 8/1987 | Van Driesen et al. |
| 4,698,147 | A | | 10/1987 | McConaghy, Jr. |
| 4,715,946 | A | | 12/1987 | Le Page et al. |
| 4,810,367 | A | | 3/1989 | Chombart et al. |
| 5,228,978 | A | | 7/1993 | Taylor et al. |
| 5,286,371 | A | * | 2/1994 | Goval et al. ..... 208/131 |
| 5,914,010 | A | | 6/1999 | Hood et al. |
| 5,919,355 | A | | 7/1999 | Hood |
| 5,958,365 | A | | 9/1999 | Liu |
| 5,980,730 | A | | 11/1999 | Morel et al. |
| 6,017,441 | A | | 1/2000 | Morel et al. |
| 6,106,701 | A | | 8/2000 | Hart |
| 6,183,627 | B1 | | 2/2001 | Friday et al. |
| 6,274,003 | B1 | | 8/2001 | Friday et al. |
| 6,702,936 | B2 | | 3/2004 | Rettger et al. |

FOREIGN PATENT DOCUMENTS

| | | |
|---|---|---|
| EP | 0 216 448 | 4/1987 |

* cited by examiner

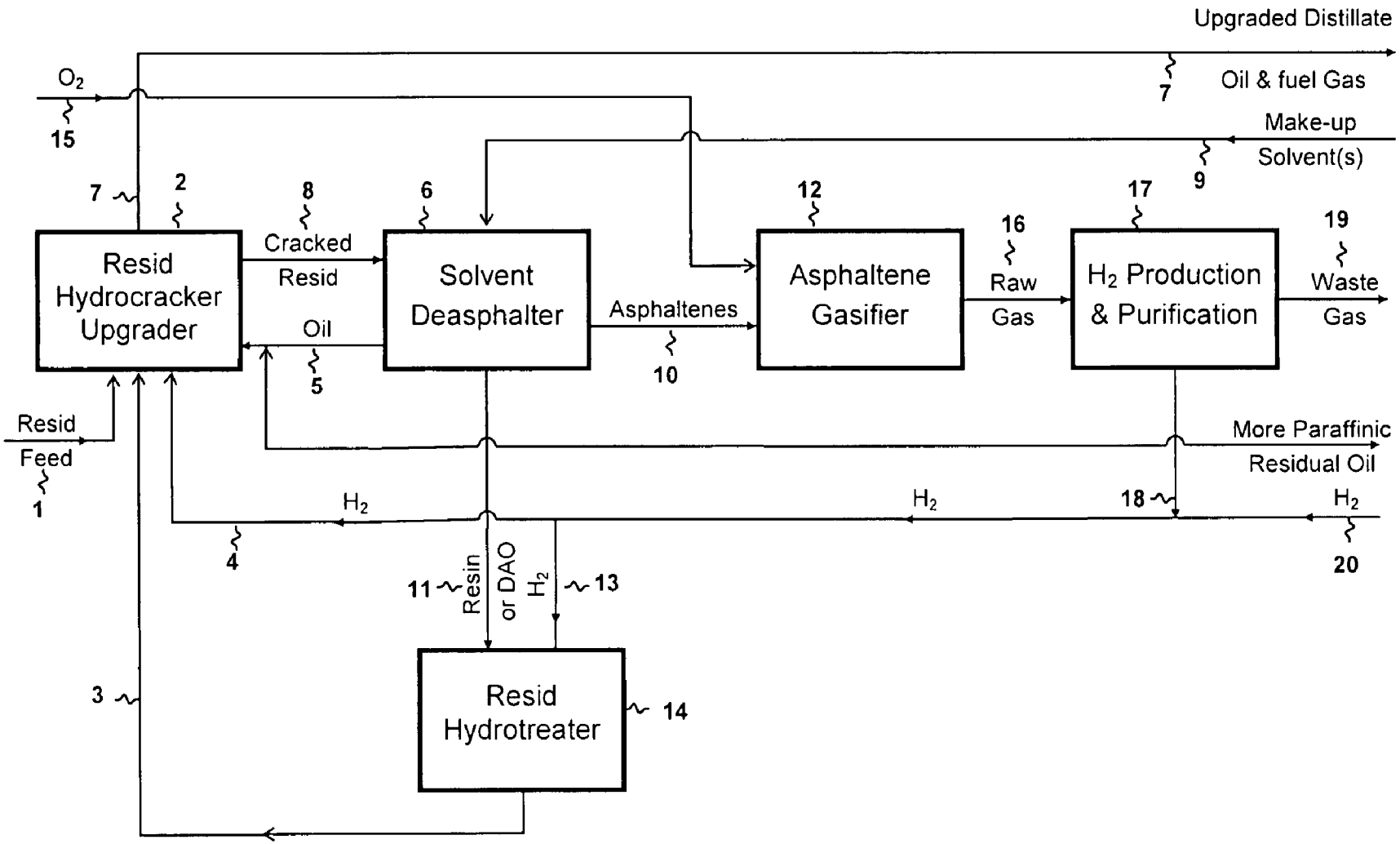
Upgraded Distillate
7
Oil & fuel Gas
Make-up
Solvent(s)
9
19
Waste
Gas
More Paraffinic
Residual Oil
$H_2$
20
17
$H_2$ Production & Purification
18
16
Raw
Gas
$H_2$
12
Asphaltene Gasifier
Asphaltenes
10
14
13
$H_2$
or DAO
Resin
11
Resid Hydrotreater
6
Solvent Deasphalter
8
Cracked
Resid
Oil
5
$H_2$
4
2
Resid Hydrocracker Upgrader
7
$O_2$
15
Resid
Feed
1
3

HYDROGEN DONOR SOLVENT PRODUCTION AND USE IN RESID HYDROCRACKING PROCESSES

BACKGROUND OF THE INVENTION

This invention pertains to a method for the production and use of hydrogen donor solvents to increase the efficiency of processes to convert hydrocarbon residua feedstocks to lower boiling hydrocarbon liquid products.

It is well known that more hydrogen rich and lower boiling point hydrocarbon distillates can be produced from hydrogen deficient petroleum residua (resid) by thermally cracking in presence of a hydrogen donor diluent. U.S. Pat. No. 2,848,530 disclosed a process to produce lower boiling liquid hydrocarbons from a higher boiling hydrogen deficient petroleum oil by heat treatment in the presence of lower boiling point and partially hydrogenated aromatic-naphthenic diluent. Thermal tars, coal derived liquids, and catalytic cycle oils are preferred hydrogen donor diluent precursors.

U.S. Pat. No. 3,238,118 teaches the use of a gas oil hydrocracker to produce hydrogen donor diluent precursor. U.S. Pat. No. 4,090,947 teaches the use of a premium coker gas oil as the hydrogen donor precursor. U.S. Pat. No. 4,292,168 provides guidance on the desired hydrogen donor diluent properties using model compounds, but does not provide any guidance on commercially viable methods to produce a hydrogen donor diluent with the required properties. U.S. Pat. No. 4,363,716 teaches production of the hydrogen donor diluent precursor by contacting a gas oil stream with a molybdenum on alumina catalyst and hydrogen at 500 psia and 500° C. with a 0.5 hour residence time. One problem with all these processes is that the more aromatic hydrogen donor precursor is diluted with the less aromatic gas oil product from the hydrogen donor cracking product.

Other patents focused on increasing hydrogen donor process efficiency and maximum operable resid-to-distillates yield. U.S. Pat. No. 2,873,245 teaches the use of a second thermal cracking stage with catalytic cracking cycle (or decant) oil as make-up hydrogen donor diluent precursor. In a similar manner, U.S. Pat. No. 2,953,513 teaches the use of a second thermal cracking stage with a thermal tar hydrogen donor diluent precursor. U.S. Pat. No. 4,698,147 teaches the use of high temperature, short residence time operating conditions to increase the maximum resid conversion. U.S. Pat. No. 4,002,556 teaches the use of multiple point hydrogen donor diluent addition points to decrease the hydrogen requirement. U.S. Pat. Nos. 6,183,627 and 6,274,003 teach the use of a deasphalter to recover and recycle deasphalted oil to increase the maximum operable resid conversion to distillates by selectively removing coke precursors in the asphaltene product stream. U.S. Pat. No. 6,702,936 further increased the process efficiency by using partial oxidation of the asphaltene product to produce hydrogen for the hydrogen donor diluent cracking process.

U.S. Pat. No. 4,640,765 demonstrated that the addition of a hydrogen donor diluent to a batch ebullated bed hydrocracker increased the rate of residua conversion to distillates. Unfortunately, the addition of the hydrogen donor diluent also decreased the concentration of the residual oil in the ebullated bed hydrocracker. In a continuous ebullated hydrocracker, the adverse dilution effect is much greater than the beneficial effect of the more rapid resid conversion kinetics. As a result, efforts to increase the ebullated bed hydrocracker process maximum resid conversion and process efficiency have primarily focused on methods to selectively remove coke precursors from the reactor (U.S. Pat. Nos. 4,427,535; 4,457,830; and 4,411,768) and preventing coke precursors from precipitating in the process equipment (U.S. Pat. Nos. 4,521,295 and 4,495,060).

U.S. Pat. Nos. 5,980,730 and 6,017,441 introduced the concept of using a solvent deasphalter to remove coke precursors and recycle hydrotreated deasphalted oil to the ebullated bed resid hydrocracker. However, this process does not provide a method to control the hydrogen donor precursor properties required to produce an effective hydrogen donor solvent and recycles undesirable more paraffinic residual oil species to the ebullated bed resid hydrocracker. U.S. Pat. No. 5,228,978 teaches using a solvent deasphalting unit to separate the cracked resid product from an ebullated bed resid hydrocracker into an asphaltene coker feed stream, resin stream that is recycled to the ebullated bed resid hydrocracker, and more paraffinic residual oil stream that is fed to a conventional catalytic cracking unit. U.S. Pat. No. 4,686,028 teaches the use of a deasphalter to separate a resid oil feed into asphaltene, resin, and oil fractions and upgrading the resin fraction by visbreaking or hydrogenation.

Therefore, there remains a need for a practical means to effectively produce and use a hydrogen donor solvent in resid hydrocracking processes that has not been met by the prior processes.

SUMMARY OF INVENTION

The present invention provides for a method to use a process derived hydrogen donor solvent to increase the maximum resid conversion and resid conversion rate in an ebullated bed resid hydrocracker. The hydrogen donor solvent is produced by hydroreforming and cracking reactions within an ebullated bed resid hydrocracker, recovered as the resin fraction using a solvent deasphalting unit, regenerated in a separate hydrotreater reactor, and fed to the ebullated bed resid hydrocracker.

In one embodiment of the present invention, there is disclosed a method for increasing the maximum resid conversion and resid conversion rate in a resid hydrocracker upgrader comprising the steps:

a) producing a hydrogen donor solvent precursor in the resid hydrocracker, wherein the hydrogen donor solvent precursor is produced by hydroreforming reactions of the hydrogen donor solvent feed;

b) directing the hydrogen donor solvent precursor to a solvent deasphalting unit, wherein a resin stream containing the hydrogen donor solvent precursor is formed;

c) directing the resin stream to a resid hydrotreater unit, wherein a hydrogen donor solvent is regenerated; and d) directing the hydrogen donor solvent to the resid hydrocracker upgrader.

In a further embodiment of the present invention, there is disclosed a method for increasing the maximum resid conversion and resid conversion rate in a resid hydrocracker upgrader comprising the steps:

a) producing a hydrogen donor solvent precursor in the resid hydrocracker, wherein the precursor is produced by hydrocracking of the resid feed;

b) directing the hydrogen donor solvent precursor to a solvent deasphalting unit, wherein a resin stream containing the hydrogen donor solvent precursor is formed;

c) directing the resin stream to a resid hydrotreater unit, wherein a hydrogen donor solvent is regenerated; and d) directing the hydrogen donor solvent to the resid hydrocracker upgrader.

A simplified reaction system may be useful to illustrate the hydrogen donor process concept and differentiate this invention from the prior art. For simplicity, this reaction system uses a phenanthrene hydrogen donor diluent precursor to illustrate the hydrogen donor process. However, this invention advantageously uses the much higher molecular weight, more complex, and higher boiling point resin hydrogen donor solvent. The hydrogen donor process typically starts by hydrogenating a hydrogen donor precursor solvent or diluent at moderate temperature and high pressure in the presence of a catalyst such as nickel-molybdate, to partially saturate the conjugated aromatic ring structure, which is represented by dihydrophenanthrene. The hydrogen donor solvent or diluent is mixed with the residual oil and fed to a resid hydrocracker upgrader. Hydrogen radicals (H) are produced by the hydrogen donor solvent or diluent to decrease the polymerization rate of the cracked products. Then, the spent hydrogen donor solvent is recovered by distillation and deasphalting and recycled to the hydrotreating step. The prior art exclusively uses distillation or the combination of reaction and distillation to produce a distillate process derived hydrogen donor diluent precursor. This invention uses solvent deasphalting to produce a non-distillable resin hydrogen donor solvent precursor.

nents in the resid feed by weight have normal boiling points greater than 450° C., more preferably greater than 480° C., and more preferably about 520° C. Typically, an appropriate resid feed has a Conradson Carbon content greater than 10 weight %, greater than or about 1 weight % sulfur, vanadium and nickel content greater than 100 ppm, heptane insoluble fraction greater than about 5 weight %, and hydrogen to carbon atomic ratios less than about 1.2, and density great than about 1.0 gm/cm$^3$.

The resid hydrocracker upgrader 2 converts the resid feed 1, recycle donor solvent feed 3, and optional oil product feed 5 from a deasphalter 6 to petroleum distillates through line 7 and cracked resid through line 8 products. The resid hydrocracker upgrader 2 would typically consist of a conventional ebullated bed hydrocracker (see U.S. Pat. No. 4,686,028 for process details), atmospheric distillation column, and vacuum distillation column.

The ebullated bed hydrocracker (resid hydrocracker upgrader 2) typically operates in a hydrogen partial pressure range between 50 and 210 bar and typically about 140 bar, temperature range of 410 to 530° C. and typically about 470° C., and a hydrogen donor solvent to resid feed weight ratio

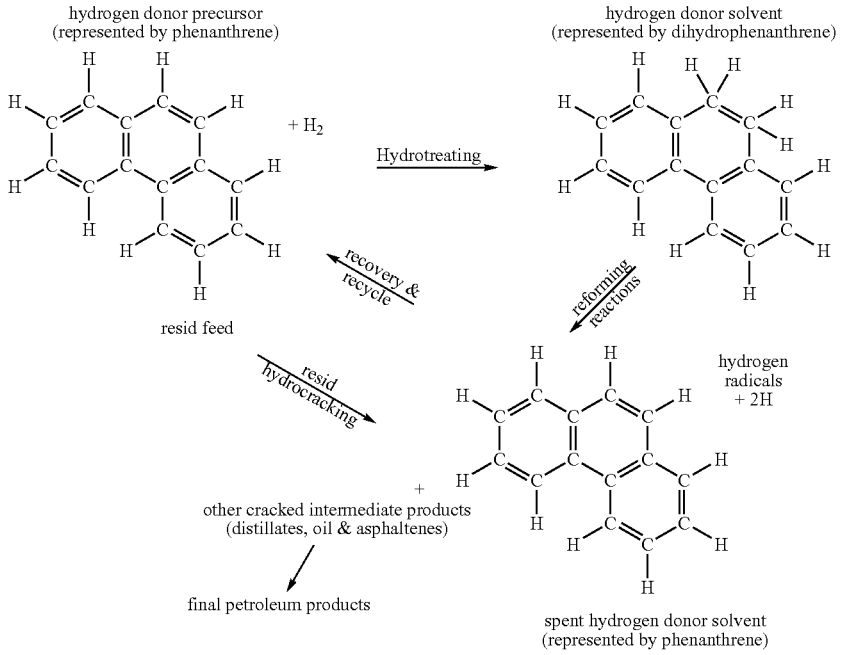

BRIEF DESCRIPTION OF DRAWINGS

The FIGURE is a schematic of a process according to one embodiment of the present invention.

DETAILED DESCRIPTION OF THE INVENTION

A description of the preferred embodiment of this invention utilizes the stream and unit operation equipment identification numbers on the FIGURE. The preferred process operating conditions are highly dependent on the properties of the resid feed 1. The residual oil feed may be derived from a wide variety of hydrocarbon sources, e.g., petroleum oil, bitumen, coal derived liquids, or biomass. Distillates are preferably removed from the hydrocarbon resid source by conventional vacuum distillation. Preferably 95% of the comporange of 0.1 to 1. The liquid reactant residence time is adjusted to provide a resid-to-distillate conversions between 30% and 90% and typically about 70%. The ebullated bed hydrocracker typically uses a conventional cobalt-molybdenum, nickel-molybdenum or nickel-cobalt-molybdenum on alumina catalyst in a spherical or extrudate form with a means to periodically replace a portion of the catalyst inventory with fresh catalyst during normal operations. In addition, a conventional colloidal molybdenum sulfide catalyst may be advantageously used. The preferred ebullated bed hydrocracker operating conditions are highly dependent on the resid feed 1 source and are best determined based on pilot plant tests. An ebullated bed hydrocracker typically operates with a temperature between 415 and 450° C., a hydrogen partial pressure 140 and 210 bar, a ratio of the hourly resid volumetric feed rate to reactor volume between 0.25 and 5, and cobalt-molybdate or nickel-molybdate catalyst bed at between 5 and 30% volume expansion. The cracked resid product in line 8 is typically produced by first removing gas and distillate components in a distillation column operating at a pressure slightly greater than atmospheric pressure and then removing a majority of the remaining distillate components in a vacuum distillation to produce the upgraded distillate oil 7 product stream and the cracked resid feed through line 8 to deasphalter 6.

The methods for the production of asphaltene in line 10, resin in line 11, and deasphalted oil in line 5 products in a deasphalter 6 are well established (U.S. Pat. Nos. 4,686,028; 4,715,946; 4,810,367; 5,228,978; 5,914,010; 5,919,355; and 6,106,701). The deasphalting process separates species in residual oil based on their solubility in paraffinic solvents. The effectiveness of the solvent in line 9 can be decreased by any combination of increasing the number of carbon atoms in the paraffinic solvent (usually between 3 and 5 carbons) or approaching the solvent's critical temperature by decreasing the solvent's temperature. Any number of deasphalter products can theoretically be produced by progressively decreasing the solvent's effectiveness and removing the separated phase. Both the deasphalter unit operation and laboratory heavy oil analytical methods use the sequential elution fractionation to separate heavy oil into fractions for analysis and products. See, for example, Klaus H. Altgelt and Mieczyslaw M. Boduszynski, "Composition and analysis of heavy petroleum fractions," Marcel Dekker, 1994, ISBN 0-8247-84946-6, page 63. A typical deasphalter unit is generally designed to produce two or three products. A two product deasphalter produces an asphaltene stream and deasphalted oil stream with the asphaltene stream having the lower solubility in the solvent. A three product deasphalter additionally produces a resin product with intermediate solubility between the oil and asphaltene products.

The deasphalter operating conditions are adjusted to provide the desired asphaltene, resin, and oil properties. In the present invention, the asphaltene product yield should be minimized with the constraint that the asphaltene product passing through line 10 can be handled by the downstream processing unit, e.g., an asphaltene gasifier 12 in the FIGURE. Oxygen is fed to the asphaltene gasifier 12 through line 15. Once the minimum practical asphaltene yield has been determined, a reasonable resin yield can be estimated based on the resin hydrogen to carbon ratio as a function of the resin yield. Analysis of laboratory scale sequential elution fractionations can be used to determine the effect of oil, resin, and asphaltene weight fraction yield on the oil, resin, and asphaltene product stream properties. The hydrogen donor solvent precursor should have a hydrogen to carbon atomic ratio that is preferably less than 1.5:1, more preferably less than 1.3:1, and most preferably less than 1.2:1. The deasphalter oil product in line 5 is essentially the components in deasphalter feed 8 that did not report to either the asphaltene or resin products, which are fed to the asphaltene gasifier 12 and resid hydrotreater 11, respectively. The deasphalter oil product in line 5 may be recycled to the ebullated bed resid hydrocracker 2.

However, this deasphalter oil product is a poor ebullated bed resid hydrocracker feedstock because it has a lower cracking rate than either resin or asphaltenes and is also is a relatively poor solvent for coke precursors. This material is a more appropriate feedstock for a fluid catalytic cracker or coker.

The solvent deasphalter 6 resin product 11 and hydrogen 13 are fed to a resid hydrotreater 14. The resid hydrotreater 14 may be a conventional trickle-bed, down-flow, ebullated bed, or entrained flow resid hydrotreating reactor. The trickle-bed and ebullated bed reactors would typically use a nickel-molybdenum on alumina catalyst with sufficient pore diameter to allow ready access of the resin feedstock. The entrained flow reactor would typically use a colloidal molybdenum sulfide catalyst. The ebullated bed reactor could also use a colloidal molybdenum sulfide catalyst in addition to the supported catalyst. The hydrogen feed is generally between 250 and 500 $Nm^3H_2/m^3$ resin, and is fed to resid hydrotreater 14 via line 13. The resid hydrotreater 14 operating pressure is preferably greater than the ebullated bed resid hydrocracker upgrader 2 operating pressure to allow the hydrogen donor solvent and unreacted hydrogen to flow to the ebullated bed resid hydrocracker via line 3. The resid hydrotreater generally operates in the range of about 370° to 430° C., significantly lower than the 410° to 530° C. typical operating temperature range for the ebullated bed resid hydrocracker. The resid hydrotreater 14 catalyst bed volume is adjusted such that the hydrogen consumption is between 100 and 200 $Nm^3H_2/m^3$ resin.

This invention offers a number of advantages relative to earlier processes. First, the resid hydrotreater is much more efficient than the ebullated bed resid hydrocracker because the catalyst deactivation rate due to metals and carbon deposition is much lower. The resid hydrotreater can operate at the optimum temperature for hydrogenation.

Second, the hydrogen donor solvent significantly improves the performance of the ebullated bed resid hydrocracker. The maximum operable resid conversion in an ebullated bed resid hydrocracker tends to decrease with increasing reactor operating temperature, e.g., see U.S. Pat. No. 4,427,535. Therefore, there is a decrease in reactor operability associated with an increase in the resid cracking rate. With hydrogen donor solvents and diluents, the hydrogen use efficiency and maximum operable resid conversion increases with increasing temperature e.g. see U.S. Pat. Nos. 4,698,147 and 4,002,556. The major advantage of a process derived resin hydrogen donor solvent relative to distillate hydrogen donor diluent is that a process derived resin hydrogen donor solvent provides the opportunity to significantly increase resid hydrocracker operability at high temperature without diluting the resid reactant with a distillate hydrogen donor diluent.

Since asphaltenes in line 10 are not stable, a method must be identified to promptly and usefully dispose of this troublesome material. Conventional pitch gasification for hydrogen production (see U.S. Pat. Nos. 4,115,246 and 5,958,365 and Gasification by Christopher Higman and Maarten van der Bugrt-SBN 0-7506-7707-4) is the preferred asphaltene disposal method. The raw gas leaves the asphaltene gasifier through line 16 and enters the hydrogen production and purification unit 17. Hydrogen from the hydrogen production and purification unit leaves through line 18 where it may optionally connected with a supplemental hydrogen source 20 and is available for use in the resid hydrotreater 14 through line 13 and the resid hydrocracker 2 through line 4. Waste gas from the hydrogen production and purification unit 17 leaves through line 19 where it can be disposed of or employed in an appropriate manner.

While this invention has been described with respect to particular embodiments thereof, it is apparent that numerous other forms and modifications of the invention will be obvious to those skilled in the art. The appending claims in this invention generally should be construed to cover all such obvious forms and modifications which are within the true spirit and scope of the present invention.

Having thus described the invention, what I claim is:

1. A method for increasing the maximum resid conversion and resid conversion rate in a resid hydrocracker upgrader comprising the steps:

a) producing a hydrogen donor solvent precursor in said resid hydrocracker, wherein said precursor is produced by hydroreforming reactions;

b) recovering hydrocracker cracked distillate oils by distillation and directing hydrocracker cracked resid product from said resid hydrocracker to a solvent deasphalting unit, wherein a resin stream containing said hydrogen donor solvent precursor is separated from oil and asphaltene species in said hydrocracker cracked resid product;

c) directing said resin stream to a resid hydrotreater unit, wherein a hydrogen donor solvent is regenerated; and d) directing said hydrogen donor solvent to said resid hydrocracker upgrader.

2. The method as claimed in claim 1 wherein said resid hydrocracker upgrader comprises an ebullated bed hydrocracker, atmospheric distillation column and vacuum distillation column.

3. The method as claimed in claim 2 wherein said ebullated bed hydrocracker operates at a hydrogen partial pressure of 50 to 210 bar.

4. The method as claimed in claim 2 wherein said ebullated bed hydrocracker operates at a temperature of about 410° C. to 530° C.

5. The method as claimed in claim 1 wherein the feed of residual oil feed is selected from the group consisting of petroleum oil, bitumen, coal derived liquids, and biomass.

6. The method as claimed in claim 2 wherein the hydrogen donor solvent to resid feed weight ratio range is about 0.1 to 1 in said ebullated bed hydrocracker.

7. The method as claimed in claim 2 wherein said ebullated bed hydrocracker contains a catalyst selected from the group consisting of cobalt-molybdenum, nickel-molybdenum and nickel-cobalt-molybdenum on alumina catalyst.

8. The method as claimed in claim 1 wherein said hydrogen donor solvent precursor has a hydrogen to carbon ratio of less than about 1.5 to 1.

9. The method as claimed in claim 1 wherein asphaltene product formation is minimized in said solvent deasphalting unit.

10. The method as claimed in claim 9 wherein the number of carbon atoms in the solvent entering said solvent deasphalting unit is increased.

11. The method as claimed in claim 9 wherein the temperature of the solvent entering said solvent deasphalting unit is reduced.

12. The method as claimed in claim 1 wherein said resid hydrotreater is a down-flow, trickle-flow, ebullated bed, or entrained flow reactor.

13. The method as claimed in claim 12 wherein said resid hydrotreater contains a supported nickel molybdate and/or collodial molybdenum sulfide catalyst.

14. The method as claimed in claim 1 wherein the feed of hydrogen to resin in said hydrotreater is between 250 and 500 $Nm^3$ hydrogen to $m^3$ resin.

15. The method as claimed in claim 14 wherein the catalyst bed volume of said resid hydrotreater is adjusted so that the hydrogen consumption is between 100 and 200 $Nm^3$ hydrogen to $m^3$ resin.

* * * * *